US011779191B2

(12) United States Patent
Boyer

(10) Patent No.: US 11,779,191 B2
(45) Date of Patent: Oct. 10, 2023

(54) WHEEL SHELF FOR A DISH WASHING APPLIANCE

(71) Applicant: Midea Group Co., Ltd., Foshan (CN)

(72) Inventor: Joel Boyer, Louisville, KY (US)

(73) Assignee: MIDEA GROUP CO., LTD., Guangdong (CN)

( * ) Notice: Subject to any disclaimer, the term of this patent is extended or adjusted under 35 U.S.C. 154(b) by 0 days.

(21) Appl. No.: 17/179,907

(22) Filed: Feb. 19, 2021

(65) Prior Publication Data

US 2022/0265119 A1 Aug. 25, 2022

(51) Int. Cl.
*A47L 15/50* (2006.01)
*A47L 15/42* (2006.01)

(52) U.S. Cl.
CPC ..... *A47L 15/507* (2013.01); *A47L 15/4257* (2013.01); *A47L 15/4261* (2013.01); *A47L 15/50* (2013.01); *A47L 15/4251* (2013.01)

(58) Field of Classification Search
CPC .. A47L 15/507; A47L 15/4257; A47L 15/461; A47L 15/4251; A47L 15/50; A47L 15/4261
See application file for complete search history.

(56) References Cited

U.S. PATENT DOCUMENTS

| | | | | |
|---|---|---|---|---|
| 3,099,585 | A | 7/1963 | Kahn | |
| 4,951,693 | A | 8/1990 | Archambault | |
| 7,159,415 | B2 * | 1/2007 | Wood | B65D 88/126 62/441 |
| 7,334,589 | B2 | 2/2008 | Jordan et al. | |
| 8,931,859 | B2 | 1/2015 | Kozinski et al. | |
| 9,345,382 | B2 | 5/2016 | Carr et al. | |
| 9,895,046 | B1 * | 2/2018 | Wilson | A47L 15/506 |
| 2009/0007374 | A1 | 1/2009 | Tynes et al. | |
| 2014/0102491 | A1 | 4/2014 | Bhajak et al. | |
| 2017/0354309 | A1 * | 12/2017 | Kim | A47L 15/4221 |

FOREIGN PATENT DOCUMENTS

| | | | | |
|---|---|---|---|---|
| CN | 114098585 | A | 3/2022 | |
| CN | 218528676 | U | 2/2023 | |
| DE | 102017201227 | B3 * | 3/2018 | |
| JP | 2009207795 | A | 9/2009 | |
| KR | 19980031288 | U | 8/1998 | |
| KR | 20060077350 | A * | 7/2006 | |
| KR | 20120107221 | A * | 10/2012 | |
| WO | WO-2008055835 | A1 * | 5/2008 | A47L 15/4257 |

OTHER PUBLICATIONS

Bosch, Bosch Custom Dishwasher Planning Guide, BSH Home Appliances Corporation, 2011.

* cited by examiner

*Primary Examiner* — Kimberley S Wright
(74) *Attorney, Agent, or Firm* — Gray Ice Higdon

(57) ABSTRACT

A shelf for an appliance such as a dish washing appliance. The shelf may include an intermediate wheel shelf. The intermediate wheel shelf may include a biasing member. The intermediate wheel shelf may be pivotable between one or more positions. The intermediate wheel shelf may form a substantially continuous wheel shelf configuration with one or more wheel shelves.

12 Claims, 6 Drawing Sheets

WHEEL SHELF FOR A DISH WASHING APPLIANCE

BACKGROUND

The present embodiments relate to a wheel shelf for a dish washing appliance, particularly a wheel shelf for a dish washing rack.

Typical racks, baskets, drawers, or shelves include wheels to traverse a space, channel, or gap between the door and tub (e.g. two wheel shelves) of a dish washing appliance. However, this practice may often include at least one wheel being caught or snagged on the gap resulting in an undesirable bump, delay, or movement of the rack experienced by the user when deploying and/or stowing the rack (e.g. lower rack). Thus, there is a need for a dish washer rack to be easily stowed and/or deployed across the gap or discontinuous wheel shelf.

SUMMARY

In some embodiments of the invention, for example, a dish washing appliance may include a dishwasher tub defining an opening. In various embodiments, the tub may include a first wheel shelf. In some embodiments, the dish washing appliance may include a door pivotably coupled with the tub to cover the opening of the tub. In various embodiments, the door may be hinged about a first hinge between a closed position to cover the opening of the tub and an open position providing access through the opening of the tub. In addition, in some embodiments, the door may include a second wheel shelf. In various embodiments, the dish washing appliance may include an intermediate wheel shelf connecting the first wheel shelf and the second wheel shelf when the door is in the open position. Moreover, in some embodiments, at least one rack may have a plurality of wheels, wherein at least one wheel of the plurality of wheels engage the first wheel shelf, the second wheel shelf, and the intermediate wheel shelf when positioning at least one rack between a stowed position within the dishwasher tub and a deployed position different from the stowed position.

In various embodiments, the intermediate wheel shelf may include a second hinge, wherein the intermediate wheel shelf may be pivotable about the second hinge. In some embodiments, the intermediate wheel shelf may be pivotably connected to the door about the second hinge. In various embodiments, the intermediate wheel shelf may be pivotably connected to the tub about the second hinge. In addition, in some embodiments, the intermediate wheel shelf may include a biasing member. In various embodiments, the biasing member may tension the intermediate wheel shelf towards a first pivoting position. In some embodiments, the first pivoting position may be a horizontal orientation. In various embodiments, the door may drive the intermediate wheel shelf between a first pivoting position and a second pivoting position different from the first pivoting position.

In some embodiments, a dish washing appliance may include a dishwasher tub defining an opening. In various embodiments, the tub may include a first wheel shelf. In various embodiments, the dish washing appliance may include a door pivotably coupled with the tub to cover the opening of the tub. In some embodiments, the door may be hinged about a first hinge between a closed position to cover the opening of the tub and an open position providing access through the opening of the tub. In various embodiments, the door may include a second wheel shelf. In some embodiments, the dish washing appliance may include a gap between the first wheel shelf and the second wheel shelf when the door is in the open position. In various embodiments, the dish washing appliance may include an intermediate wheel shelf. In some embodiments, when in a first pivoting position the intermediate wheel shelf bridges the gap between the first wheel shelf and the second wheel shelf, thereby connecting the first wheel shelf and the second wheel shelf to create a substantially continuous and horizontal wheel shelf extending across the gap when the door is in the open position. In addition, in some embodiments, at least one rack may have a plurality of wheels, wherein at least one wheel of the plurality of wheels engage the first wheel shelf, the second wheel shelf, and the intermediate wheel shelf to traverse the gap when positioning the rack between a stowed position within the dishwasher tub and a deployed position different from the stowed position.

In various embodiments, the intermediate wheel shelf may pivot between the first pivoting position and a second pivoting position different from the first pivoting position. In some embodiments, the door may drive the intermediate wheel shelf between the first pivoting position and the second pivoting position. In various embodiments, the intermediate wheel shelf may be pivotably connected to the door about a second hinge. Moreover, in some embodiments, the intermediate wheel shelf may be in a first orientation when the door is in both the open position and the closed position. In various embodiments, the intermediate wheel shelf may be pivotably connected to the tub about a second hinge. In some embodiments, the intermediate wheel shelf may include a biasing member. In various embodiments, the biasing member may tension the intermediate wheel shelf towards the first pivoting position, wherein the first pivoting position is a horizontal orientation. In some embodiments, the intermediate wheel shelf may include a first intermediate wheel shelf and a second intermediate wheel shelf.

In addition, in various embodiments, a method of bridging a gap between a door and a dishwasher tub with an intermediate wheel shelf may include providing a dishwasher tub and a door pivoting relative to the dishwasher tub between a closed position and an open position, and wherein the tub includes a first wheel shelf and the door includes a second wheel shelf. In some embodiments, the method may include biasing an intermediate wheel shelf into a first pivoting position bridging a gap between the first wheel shelf and the second wheel shelf, thereby connecting the first wheel shelf and the second wheel shelf. In various embodiments, the method may include creating a substantially continuous and horizontal wheel shelf made of the intermediate wheel shelf, the first wheel shelf, and the second wheel shelf when the door is in the open position.

In various embodiments, the method may include pivoting the intermediate wheel shelf between the first pivoting position and a second pivoting position. In some embodiments, the method may include driving the intermediate wheel shelf between the first pivoting position and the second pivoting position. In some embodiments, the intermediate wheel shelf may b pivotably coupled to the tub. In addition, in various embodiments, the intermediate wheel shelf may be pivotably coupled to the door.

These and other advantages and features, which characterize the embodiments, are set forth in the claims annexed hereto and form a further part hereof. However, for a better understanding of the embodiments, and of the advantages and objectives attained through its use, reference should be made to the drawings and to the accompanying descriptive matter, in which there are described example embodiments. This summary is merely provided to introduce a selection of concepts that are further described below in the detailed description, and is not intended to identify key or essential features of the claimed subject matter, nor is it intended to be used to limit the scope of the claimed subject matter, nor to define the field of endeavor.

BRIEF DESCRIPTION OF THE DRAWINGS

In the drawings, like reference characters generally refer to the same parts throughout the different views. Also, the drawings are not necessarily to scale, emphasis instead generally being placed upon illustrating the principles of the invention.

DETAILED DESCRIPTION

Figure 1:
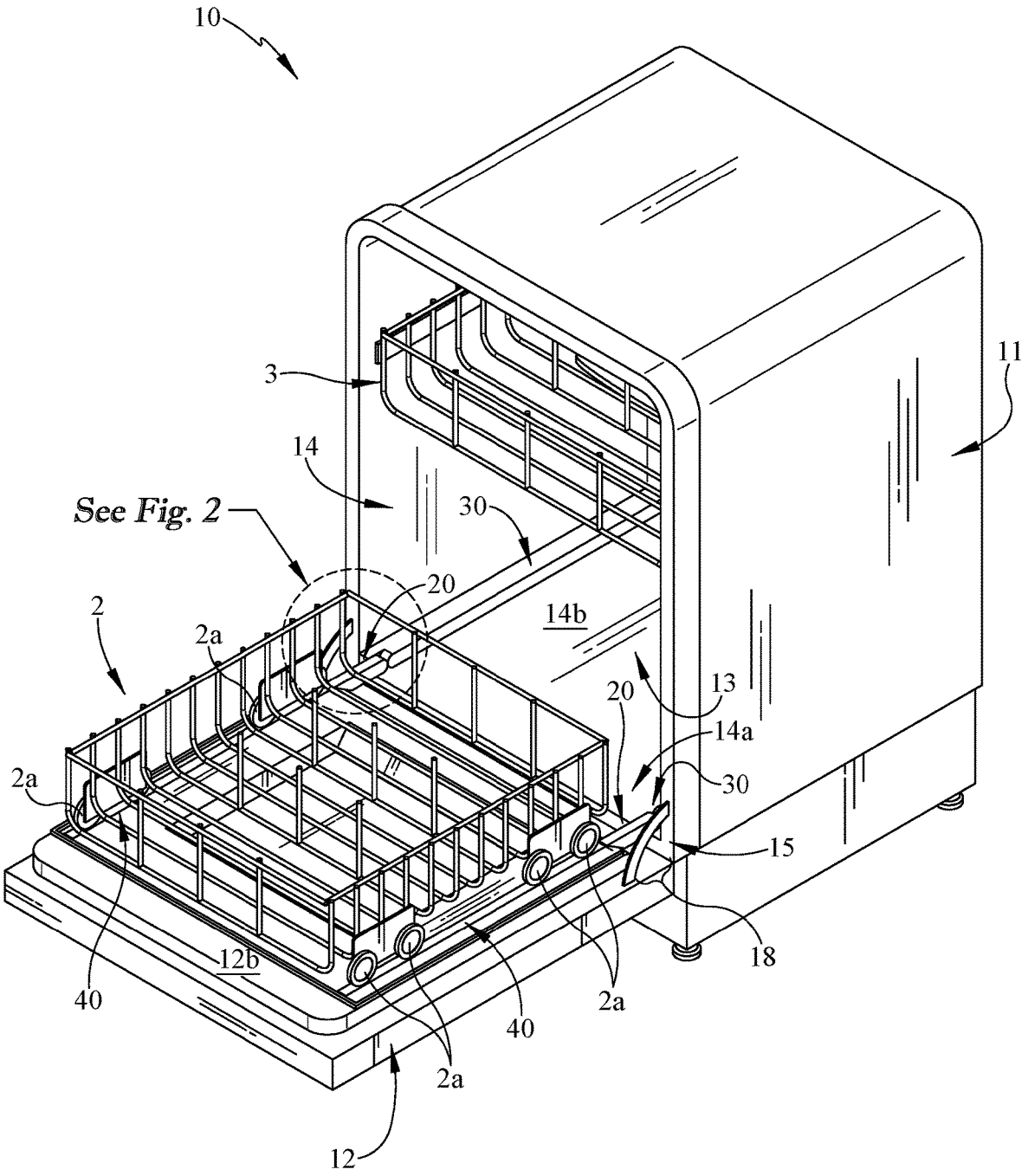
FIG. 1 is a perspective view of one embodiment of an intermediate wheel shelf of a dish washing machine in a first pivoting position, illustrating a lower rack in a deployed position and a door in an open position relative to a dish washer tub.

Numerous variations and modifications will be apparent to one of ordinary skill in the art, as will become apparent from the description below. Therefore, the invention is not limited to the specific implementations discussed herein.

The embodiments discussed hereinafter will focus on the implementation of the hereinafter-described apparatus and techniques within a front-load residential dish washing machine such as dish washing appliance 10, such as the type that may be used in single-family or multi-family dwellings, or in other similar applications. However, it will be appreciated that the herein-described apparatus and techniques may also be used in connection with other types of dish washing machines in some embodiments. For example, the herein-described apparatus and techniques may be used in commercial applications in some embodiments. Moreover, the herein-described apparatus and techniques may be used in connection with other appliances, such as, for example, ovens, refrigerators, freezers, and the like.

Embodiments for a dish washing machine are shown herein for ease of understanding. For example, a front-load dish washing machine that includes a front-mounted door 12 in a cabinet or housing 11 that provides access to one or more horizontally-oriented dishwasher racks or assemblies 2, 3 housed within the cabinet or housing 11 may be used. More specifically, the dishwasher rack 2, 3 may be housed in a dishwasher tub 14. Implementation of the herein-described apparatus and techniques within a variety of appliances would be well within the abilities of one of ordinary skill in the art having the benefit of the instant disclosure, so the invention is not limited to the front-load dish washing implementation discussed further herein. For example, the apparatus and techniques may be used with a dishwasher drawer of a dish washing appliance.

Turning now to the drawings, wherein like numbers denote like parts throughout the several views, FIGS. 1-6 illustrates an example dish washing appliance 10 in which the various technologies and techniques described herein may be implemented. Dish washing appliance 10 is a front-load dish washing machine and as such may include a front-mounted door 12 that operably engages and provides access to a horizontally-oriented dishwasher tub 14 defining an opening 13. The door 12 may be connected or pivotably coupled via a hinge connection (e.g. first hinge 15) with a cabinet or housing 11 that may house the dishwasher tub 14 in some embodiments. Door 12 is generally hinged along a front or front edge 14*a* of the housing 11 or tub 14 adjacent the opening 13 and is configured to pivot between the open position illustrated in FIGS. 1-3 and 5 and a closed position in FIGS. 4 and 6. When door 12 is in the open position, dishes, utensils, pans, and other washable items may be inserted into and removed from the one or more dishwasher racks 2, 3 through the opening 13 in the front of cabinet or housing 11. When in the closed position, the door 12 covers the opening 13 of the tub 14. Control over dish washing appliance 10 by a user is generally managed through a control panel disposed on a door 12 and implementing a user interface (not shown), and it will be appreciated that in different dish washing machine designs, control panel may include various types of input and/or output devices, including various knobs, buttons, lights, switches, textual and/or graphical displays, touch screens, etc. through which a user may configure one or more settings and start and stop the dishwasher rack cycle or movement (e.g. automatic and/or manual) as described herein. For example, the control panel, or portions thereof, may be included with the dishwasher rack, on the interior or exterior of the door, and/or adjacent the rack within the opening of the dish washing machine. For example in some embodiments, portions of the controls may be accessible when the door is in the open position. In other embodiments, the one or more racks or portions thereof may close/open, lock, and/or unlock from a position by proximity of one or more users and/or by a one or more gestures/forces or bodily movement relative to the rack and/or portions of the dish washing machine.

As shown in the Figures, one or more intermediate wheel shelves 20, 120 may be used span one or more gaps, channels, or spaces 18 created when a portion of the appliance 10 (e.g. the door 12) is opened or repositioned relative to a remaining portion of the dish washing appliance 10 (e.g. tub 14, housing 11, opening 13, etc.). In the one embodiment shown, the gap 18 may be between the tub 14 (e.g. bottom side 14*b*) and the door 12 (e.g. inner side 12*b*), or more specially a first wheel shelf 30 of the tub 14 and a second wheel shelf 40 of the door 12. The gap 18 may be substantially horizontal between the first and second wheel shelf 30, 40. The intermediate wheel shelf may engage or connect to one or more wheel shelves (e.g. discontinuous wheel shelves, first wheel shelf 30, second wheel shelf 40, third wheel shelf, etc.) to create a substantially continuous wheel shelf 50 for one or more racks 2 (e.g. lower rack, a plurality of wheels 2*a*) to deploy and/or stow across the gap 18. As shown in the one embodiment, the continuous wheel shelf 50 created with the intermediate wheel shelf 20, 120 may be substantially horizontal in orientation when bridging the gap 18. The substantially continuous wheel shelf 50 allows for at least one wheel 2*a* or engaging member of the rack 2 to engage or ride (e.g. slide, roll, etc.) along the one or more surfaces and/or lengths of the continuous wheel shelf 50, or portions thereof (e.g. intermediate wheel shelf 20 and one or more wheel shelves 30, 40), when positioning the at least one rack 2 between a stowed position (FIG. 1) and the deployed position (FIG. 2) different from the stowed position. As shown in the one embodiment, the one or more wheels 2*a* of the rack 2 roll along at least the top surface 20*a* of the intermediate wheel shelf 20 and connected wheel shelves (e.g. top surfaces 30*a*, 40*a*) to traverse the gap 18. Although a wheel is shown in the embodiments as engaging the intermediate wheel shelf or other portions of the continuous wheel shelf from the rack, it is understood another type of engaging member or members may travel along and engage the contacting surfaces of the wheel shelves. For example, a cylindrical bearing of a rack may be an embodiment of a contact member using the intermediate shelf.

Figure 2:
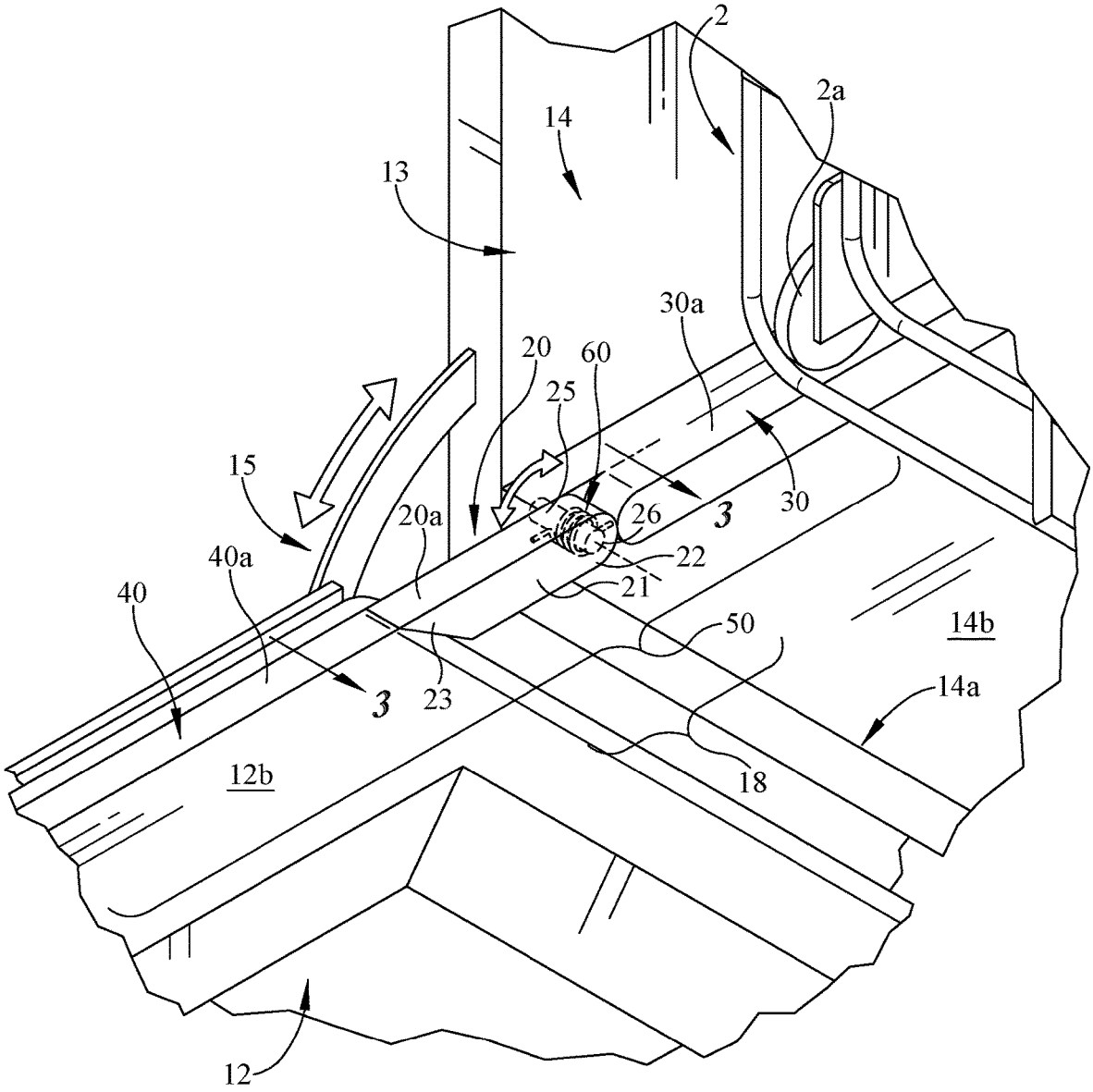
FIG. 2 is a perspective view of the embodiment of the intermediate wheel shelf in the first pivoting position of FIG. 1 hinged to the tub with a biasing member shown in broken lines, and illustrating the lower rack in a stowed position.
Figure 3:
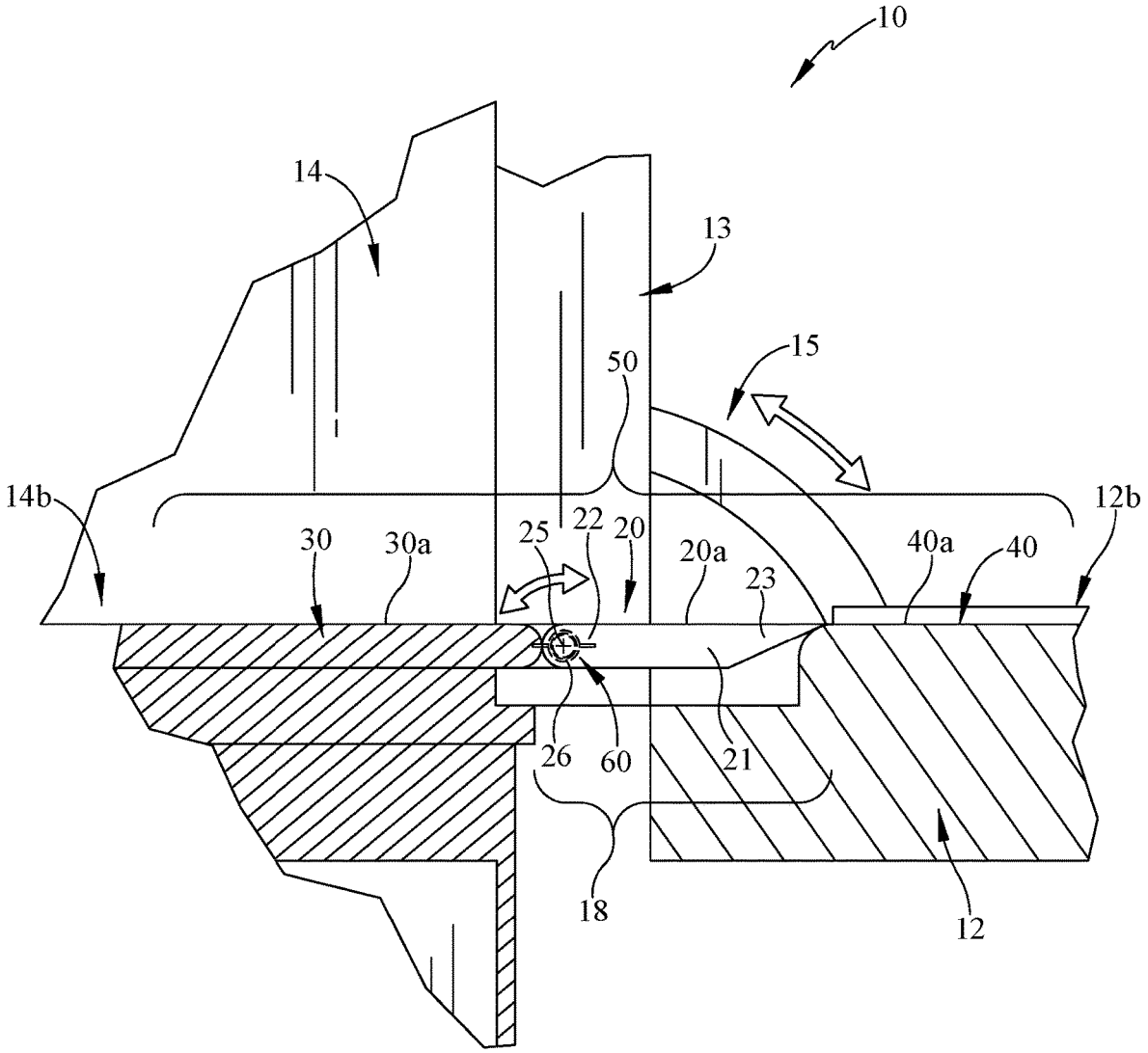
FIG. 3 is a sectional view of the dish washing appliance of FIG. 2 taken along line 3-3 illustrating the door in the open position and the intermediate wheel shelf in the first pivoting position relative to the tub.
Figure 4:
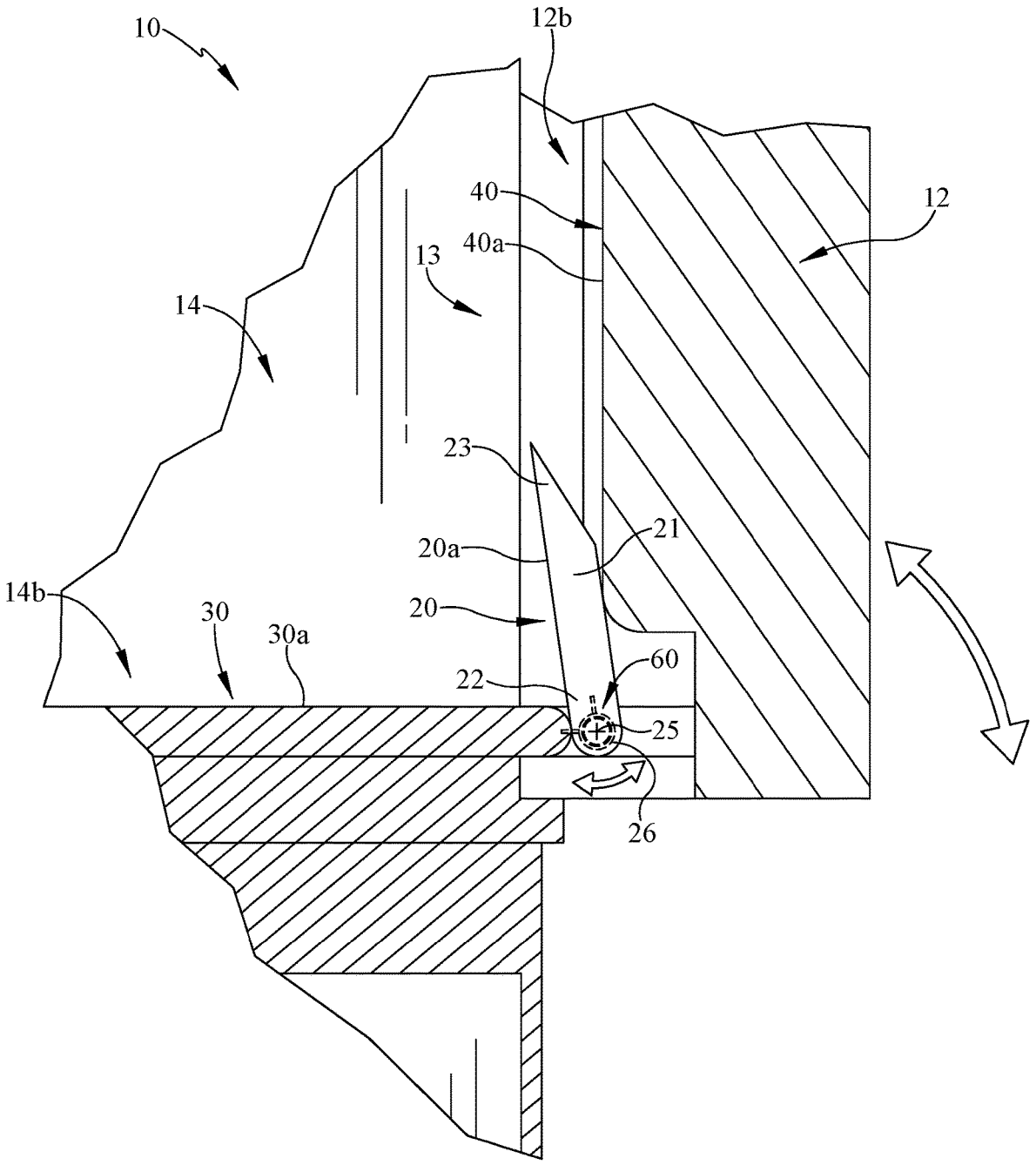
FIG. 4 is a sectional view of the dish washing appliance of FIG. 2 taken along line 3-3 illustrating the door in a closed position and the intermediate wheel shelf in a second pivoting position relative to the tub.
Figure 5:
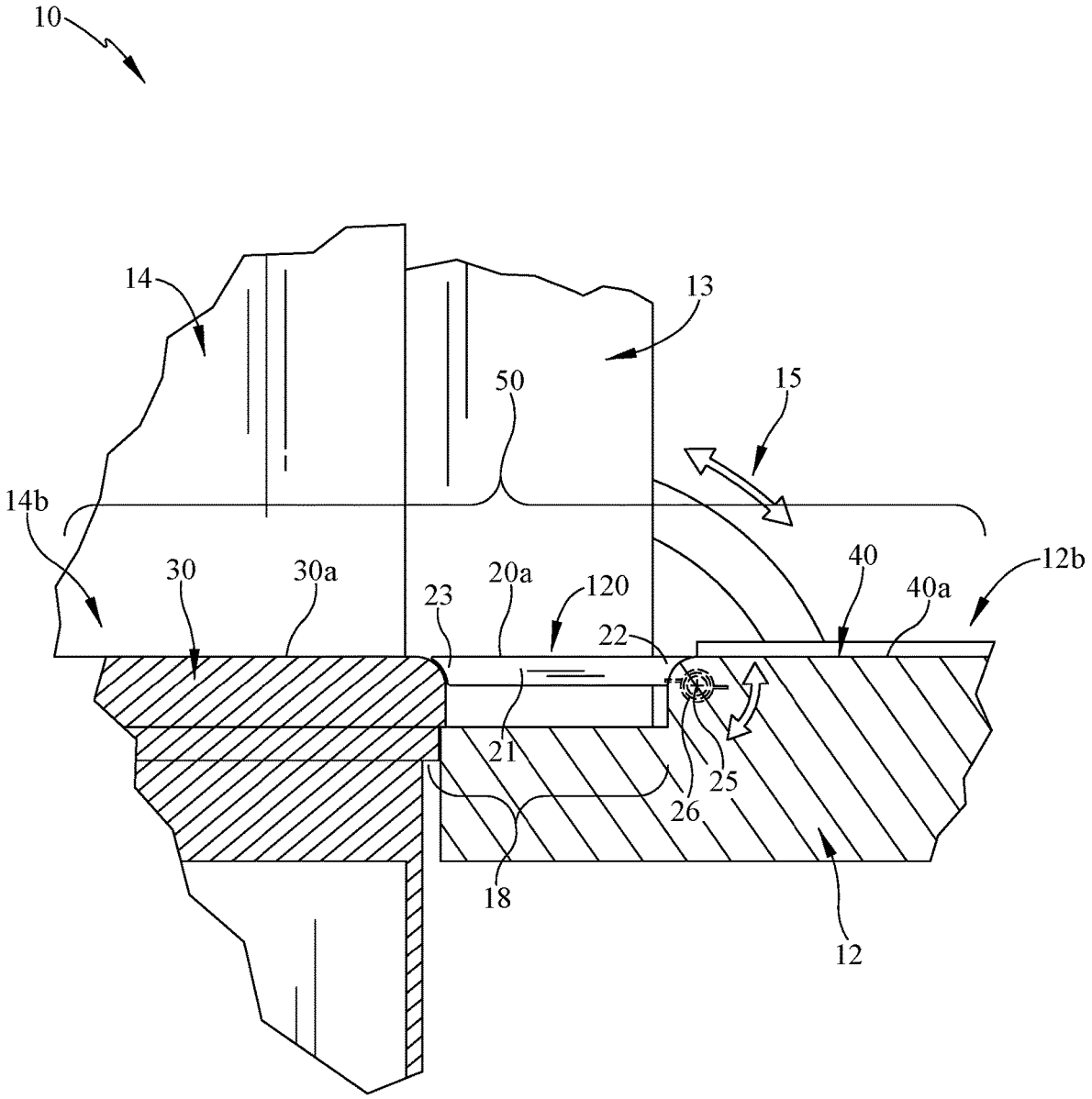
FIG. 5 is sectional view of the dish washing appliance taken along 3-3 illustrating another embodiment of an intermediate wheel shelf in a first pivoting position relative to the door when the door is in the open position.
Figure 6:
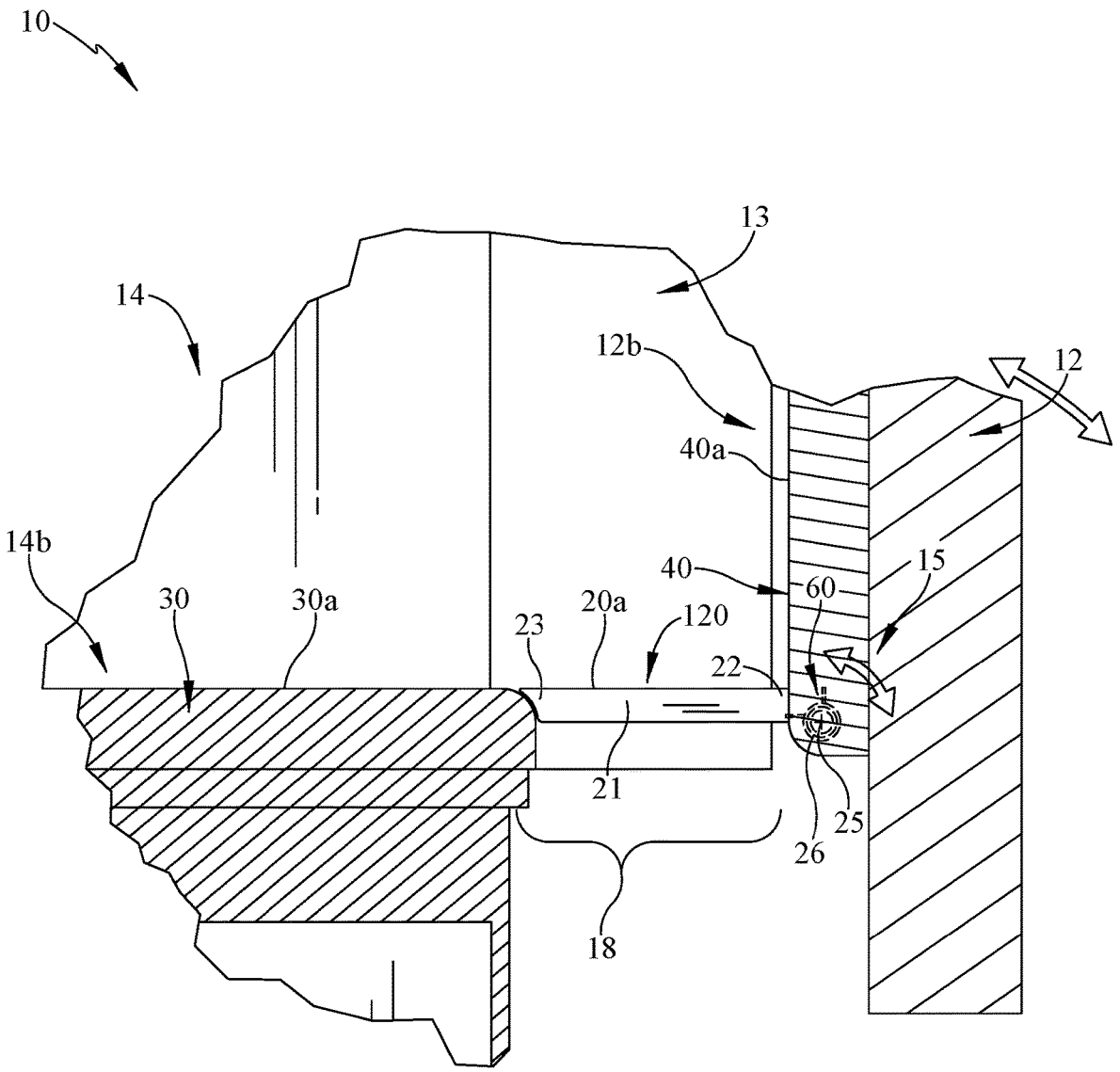
FIG. 6 is sectional view of the embodiment of the intermediate wheel shelf in FIG. 5 illustrating the door in a closed position and the intermediate wheel shelf in a second pivoting position relative to the door.

In some implementations, the intermediate member, track, or wheel shelf 20, 120 may be in variety of positions relative to the one or more additional member, track, or wheel shelves 30, 40. As shown in the one embodiment, the intermediate wheel shelf 20, 120 is shown between or connecting the first wheel shelf 30 and the second wheel shelf 40 creating/forming the continuous wheel shelf 50 extending the length of travel for the rack 2 or wheel 2*a* to cross/bridge the gap 18. As shown in the one embodiment, the tub 14 may include the first wheel shelf 30 and the door 12 may include the second wheel shelf 40. As shown in the one embodiment, the bottom side 14*b* of the tub 14 may include the first wheel shelf 30 and an inner side 12*b* of the door 12 may include the second wheel shelf 40. When the door 12 is in the open position as shown in FIGS. 1-3 and 5, the intermediate wheel shelf 20, 120 (e.g. in a first pivoting position) connects with the first wheel shelf 30 and the second wheel shelf 40 to bridge the gap 18. When interconnected between the two shelves 30, 40, the intermediate wheel shelf 20, 120 spans the gap 18 and may be horizontal in orientation and/or at the same height/elevation as the adjacent wheel shelves. When the door 12 is in the closed position as shown in FIGS. 4 and 6, the intermediate wheel shelf 20, 120 may be in the second pivoting position. In the second pivoting position, one or more of the wheel shelves may be out of alignment or discontinuous with one or more of the remaining wheel shelves. As shown in FIG. 4, the first wheel shelf 30, intermediate shelf 20, and the second wheel shelf 40 are out of alignment (e.g. not horizontal, continuous) with each other when the intermediate wheel shelf 20 is in the second pivoting position. As shown in FIG. 6, the second wheel shelf 40 of the door is out of alignment (e.g. not horizontal, continuous) with the intermediate wheel shelf 120 and the first wheel shelf 30 of the tub 14. The intermediate wheel shelf 20 may be in the second pivoting position, FIG. 4, that is different from the first pivoting position, FIG. 3, which results in a different orientation of the intermediate wheel shelf. As shown in FIG. 3, the intermediate wheel shelf 20 is in a horizontal orientation when in the first pivoting position. As shown in FIG. 4, the intermediate wheel shelf 20 is in a different, non-horizontal, or vertical orientation when in the second pivoting position. In other embodiments, the intermediate wheel shelf 120 may be in the second pivoting position, FIG. 6, that is different from the first pivoting position, FIG. 5, and still maintain the same orientation (e.g. horizontal) of the intermediate wheel shelf.

In some implementations, the intermediate wheel shelf 20, 120 may include at least one elongated member 21 with opposing ends 22, 23. The elongated member 21 of the intermediate wheel shelf 20, 120 may include a hinge end 22 and an opposing free distal end 23 pivoting about the hinge end. The intermediate wheel shelf 20, 120 may include a hinge mechanism or pin (e.g. second hinge 25) engaging an aperture 26 of the hinge end 22 such that the free distal end 23 may pivot about the hinge 25 between two or more pivoting positions. In some embodiments, the intermediate wheel shelf 20, 120 may include one or more contact surfaces (e.g. top surface 20*a*) receiving/guiding/contacting the wheels 2*a* of the rack 2 for a length. The one or more contact surfaces may be a top surface 20*a*, channel, or ledge to engage the wheel. The contact surface (e.g. top surface) of the intermediate wheel shelf may be the same as the first and second wheel shelves as shown, but may be different in some embodiments.

In some implementations, the intermediate wheel shelf 20 may be hinged to the tub 14. The intermediate wheel shelf 20 may be hinged to the tub 14, directly or indirectly via the frame 11. The intermediate wheel shelf 20 may be hinged via the pin 25. The intermediate wheel shelf 20 be pivoted relative to the tub 14 in a variety of pivoting positions as shown in FIGS. 1-4. The intermediate shelf may pivot between a first pivoting position as shown in FIG. 3 and a second pivoting position as shown in FIG. 4 about the hinge 25 (e.g. second hinge).

In some implementations, the intermediate wheel shelf may be hinged to locations other than the tub (e.g. the door). The intermediate wheel shelf 120 may be hinged to the door 12, directly or indirectly. The intermediate wheel shelf may be hinged via the pin 25. The intermediate wheel shelf 120 may be pivoted relative to the door 12 in a variety of pivoting positions as shown in FIGS. 5 and 6. The intermediate wheel shelf 120 may pivot between the first pivoting position as shown in FIG. 5 and the second pivoting position as shown in FIG. 6 about the hinge (e.g. second hinge) relative to the door 12.

In various embodiments, the intermediate wheel shelf may include a biasing member. In the one embodiment shown, the biasing member 60, if used, may be a spring or other tension device. To provide the pivoting engagement between the intermediate wheel shelf 20, 120 and the respective portion of the dish washing machine (e.g. door, tub, etc.), the hinge, pin, or other suitable pivot member 25 may operably engage therebetween. The biasing member 60 may be adjacent the hinge end 22 and/or hinge 25 of the elongated member 21 of the intermediate wheel shelf 20, 120. The biasing member 60 may bias the intermediate wheel shelf 20, 120 in a pivoting direction (e.g. CCW, CW) about the hinge 25. The biasing member 60 may bias or place tension about the hinge or pivot mechanism 25 to position the intermediate wheel shelf 20, 120 towards at least one pivoting position. As shown in FIGS. 2-4, the biasing member 60 tensions the intermediate wheel shelf 20 towards the first pivoting position (e.g. horizontal orientation) when the door 12 operably opens and closes. As shown in FIGS. 5-6, the biasing member 60 tensions the intermediate wheel shelf 120 towards or to remain in the first pivoting position (e.g. horizontal orientation) when the door operably opens and closes.

In some implementations, the intermediate wheel shelf 20, 120 may be driven between pivoting positions. As shown in FIGS. 1-4, the door 12 drives or actuates the free distal end 23 about the hinge 25 (e.g. pin, hinge end 22 relative to the tub 14. The free distal end 23 of the intermediate wheel shelf 20 is forced by the door from the horizontal orientation inwardly into the tub to the substantially vertical orientation against the tension of the biasing member when the door closes from the open position to the closed position. When the door opens from the closed position to the open position, the door removes the force applied to the intermediate wheel shelf such that the biasing member 60 returns or tensions the intermediate wheel shelf 20 back to the horizontal orientation or first pivoting position to create the continuous wheel shelf configuration 50. As shown in FIGS. 5-6, the door 12 drives or actuates the intermediate wheel shelf 120 between pivoting positions relative to the door 12. The biasing member 60 maintains the orientation (e.g. horizontal) of the intermediate wheel shelf 120, when the door pivots between the open and closed position thereby changing the pivoting position of the intermediate wheel shelf 120 relative to the door 12. When the door 12 opens from the closed position to the open position the pivoting position changes away from the second pivoting position towards the first pivoting position relative to the door such that the biasing member 60 maintains or tensions the intermediate wheel shelf 120 in the horizontal orientation to create the continuous wheel shelf configuration 50.

As shown in the figures, the one or more dishwasher racks, baskets, drawers, or shelves 2 or portions thereof, may be positionable relative to the dish washing appliance 10 or dishwasher tub 14 between a stowed or un-deployed position (illustrated in FIG. 2) and a deployed or different position (illustrated in FIG. 1) using the wheel shelf configuration 50. It should be understood that the rack, may be a variety of shapes, sizes, quantities, positions (e.g. stowed and deployed) relative to the tub 14, and constructions and still be within the scope of the invention. The rack may include an appliance rack, drawer, basket, or shelf, with particular embodiments shown for a dishwasher rack for a dish washing appliance.

It should be understood that the intermediate wheel shelf 20, 120 may be a variety of shapes, sizes, quantities, pivoting positions relative to the tub 14, and/or door, and/or frame, and constructions and still be within the scope of the invention. For example, although two intermediate wheel shelves 20, 120 (e.g. first, second) are shown spaced across the gap 18 creating two wheel shelf configurations 50 along the bottom edge of the door it should be understood that a single intermediate wheel shelf may be used to interconnect with a plurality of first wheel shelves (e.g. pair) and a plurality of second wheel shelves (e.g. pair).

While several embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the teachings is/are used. Those skilled in the art will recognize, or be able to ascertain using no more than routine experimentation, many equivalents to the specific embodiments described herein. It is, therefore, to be understood that the foregoing embodiments are presented by way of example only and that, within the scope of the appended claims and equivalents thereto, embodiments may be practiced otherwise than as specifically described and claimed. Embodiments of the present disclosure are directed to each individual feature, system, article, material, and/or method described herein. In addition, any combination of two or more such features, systems, articles, materials, and/or methods, if such features, systems, articles, materials, and/or methods are not mutually inconsistent, is included within the scope of the present disclosure.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of" "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

It should also be understood that, unless clearly indicated to the contrary, in any methods claimed herein that include more than one step or act, the order of the steps or acts of the method is not necessarily limited to the order in which the steps or acts of the method are recited.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures, Section 2111.03.

It is to be understood that the embodiments are not limited in its application to the details of construction and the arrangement of components set forth in the description or illustrated in the drawings. The invention is capable of other embodiments and of being practiced or of being carried out in various ways. Unless limited otherwise, the terms "connected," "coupled," "in communication with," and "mounted," and variations thereof herein are used broadly and encompass direct and indirect connections, couplings, and mountings. In addition, the terms "connected" and "coupled" and variations thereof are not restricted to physical or mechanical connections or couplings.

The foregoing description of several embodiments of the invention has been presented for purposes of illustration. It is not intended to be exhaustive or to limit the invention to the precise steps and/or forms disclosed, and obviously many modifications and variations are possible in light of the above teaching.

The invention claimed is:

1. A dish washing appliance comprising a dishwasher tub defining an opening, wherein the tub includes a first wheel shelf;

a door pivotably coupled with the tub to cover the opening of the tub, wherein the door is hinged about a first hinge between a closed position to cover the opening of the tub and an open position providing access through the opening of the tub, and wherein the door includes a second wheel shelf;

an intermediate wheel shelf connecting the first wheel shelf and the second wheel shelf when the door is in the open position, wherein the intermediate wheel shelf includes a biasing member, and wherein the biasing member tensions the intermediate wheel shelf towards a first pivoting position, wherein the first pivoting position is a horizontal orientation, and wherein the intermediate wheel shelf is in the horizontal orientation when the door is in both the open position and the closed position; and at least one rack having a plurality of wheels, wherein at least one wheel of the plurality of wheels engage the first wheel shelf, the second wheel shelf, and the intermediate wheel shelf when positioning the at least one rack between a stowed position within the dishwasher tub and a deployed position different from the stowed position, and wherein the intermediate wheel shelf is in the horizontal orientation when the at least one rack is in both the stowed position and the deployed position.

2. The dish washing appliance of claim 1 wherein the intermediate wheel shelf includes a second hinge, wherein the intermediate wheel shelf is pivotable about the second hinge.

3. The dish washing appliance of claim 2 wherein the intermediate wheel shelf is pivotably connected to the door about the second hinge.

4. The dish washing appliance of claim 2 wherein the intermediate wheel shelf is pivotably connected to the tub about the second hinge.

5. A dish washing appliance comprising a dishwasher tub defining an opening, wherein the tub includes a first wheel shelf;

a door pivotably coupled with the tub to cover the opening of the tub, wherein the door is hinged about a first hinge between a closed position to cover the opening of the tub and an open position providing access through the opening of the tub, and wherein the door includes a second wheel shelf;

a gap between the first wheel shelf and the second wheel shelf when the door is in the open position;

an intermediate wheel shelf, wherein when in a first pivoting position the intermediate wheel shelf bridges the gap between the first wheel shelf and the second wheel shelf, thereby connecting the first wheel shelf and the second wheel shelf to create a substantially continuous and horizontal wheel shelf extending across the gap when the door is in the open position;

wherein the intermediate wheel shelf includes a biasing member, wherein the biasing member tensions the intermediate wheel shelf towards the first pivoting position, wherein the first pivoting position is a horizontal orientation;

at least one rack having a plurality of wheels, wherein at least one wheel of the plurality of wheels engage the first wheel shelf, the second wheel shelf, and the intermediate wheel shelf to traverse the gap when positioning the at least one rack between a stowed position within the dishwasher tub and a deployed position different from the stowed position; and wherein the intermediate wheel shelf is in the horizontal orientation when the door is in both the open position and the closed position and when the at least one rack is in both the stowed position and the deployed position.

6. The dish washing appliance of claim 5 wherein the intermediate wheel shelf is pivotably connected to the door about a second hinge.

7. The dish washing appliance of claim 5 wherein the intermediate wheel shelf is pivotably connected to the tub about a second hinge.

8. The dish washing appliance of claim 5 wherein the intermediate wheel shelf includes a first intermediate wheel shelf and a second intermediate wheel shelf.

9. A method of bridging a gap between a door and a dishwasher tub with an intermediate wheel shelf, the method comprising:

providing a dishwasher tub and a door pivoting relative to the dishwasher tub between a closed position and an open position, wherein the tub includes a first wheel shelf and the door includes a second wheel shelf, and at least one rack having a plurality of wheels;

positioning the at least one rack between a stowed position within the dishwasher tub and a deployed position different from the stowed position; and biasing an intermediate wheel shelf into a first pivoting position bridging a gap between the first wheel shelf and the second wheel shelf, thereby connecting the first wheel shelf and the second wheel shelf;

creating a substantially continuous and horizontal wheel shelf made of the intermediate wheel shelf, the first wheel shelf, and the second wheel shelf when the door is in the open position; and pivoting the intermediate wheel shelf between the first pivoting position and a second pivoting position, and wherein the first pivoting position and the second pivoting position are in the same horizontal position when the door is in both the open position and the closed position and when the at least one rack is in both the stowed position and the deployed position.

10. The method of claim 9 further comprising the step of driving the intermediate wheel shelf between the first pivoting position and the second pivoting position.

11. The method of claim 9 wherein the intermediate wheel shelf is pivotably coupled to the tub.

12. The method of claim 9 wherein the intermediate wheel shelf is pivotably coupled to the door.

* * * * *